US012546041B2

(12) United States Patent
Marijsse et al.

(10) Patent No.: US 12,546,041 B2
(45) Date of Patent: Feb. 10, 2026

(54) METHOD OF FORMING A PATTERNED CARPET IN A TUFTING MACHINE

(71) Applicant: VANDEWIELE NV, Kortrijk (BE)

(72) Inventors: Frank Marijsse, Kortrijk (BE); Kristof Oosterlijnck, Ooigem (BE)

(73) Assignee: VANDEWIELE NV, Kortrijk (BE)

( * ) Notice: Subject to any disclaimer, the term of this patent is extended or adjusted under 35 U.S.C. 154(b) by 0 days.

(21) Appl. No.: 18/577,639

(22) PCT Filed: Jul. 8, 2022

(86) PCT No.: PCT/EP2022/069181
§ 371 (c)(1),
(2) Date: Jan. 8, 2024

(87) PCT Pub. No.: WO2023/285325
PCT Pub. Date: Jan. 19, 2023

(65) Prior Publication Data

US 2024/0344256 A1 Oct. 17, 2024

(30) Foreign Application Priority Data

Jul. 14, 2021 (GB) ..... 2110136

(51) Int. Cl.
*D05C 15/30* (2006.01)
*D05C 13/02* (2006.01)

(52) U.S. Cl.
CPC ..... *D05C 15/30* (2013.01); *D05C 13/02* (2013.01); *D05D 2205/12* (2013.01)

(58) Field of Classification Search
CPC ..... D05C 15/26; D05C 15/30; D05C 15/34; D05C 13/02; D05D 2205/12
See application file for complete search history.

(56) References Cited

U.S. PATENT DOCUMENTS

2005/0188905 A1 9/2005 Dabrowa et al.
2017/0204546 A1* 7/2017 Padgett ..... D05C 5/04
2017/0260668 A1 9/2017 Jones et al.

FOREIGN PATENT DOCUMENTS

AU 662013 B2 8/1995

OTHER PUBLICATIONS

International Search Report and Written Opinion issued in related application PCT/EP2022/069181, dated Aug. 23, 2022.

(Continued)

*Primary Examiner* — Nathan E Durham
(74) *Attorney, Agent, or Firm* — Patterson + Sheridan, LLP

(57) ABSTRACT

A method of forming a patterned carpet in a tufting machine with a sliding needle bar (4) comprising a plurality of needles (5). The method comprising analysing desired pattern data to determine if a problem condition is present for a particular arrangement of tufts in the desired pattern data based on the relative location of at least two stitches in the desired pattern data. Changing the colour of at least one tuft from that required by the desired pattern data to create actual pattern data in which the problem condition is eliminated (or alerting to a user). The problem condition may be the tufts will be spaced by less than a predetermined amount. Alternatively, it may be that a needle (5) forming a tuft in a transitional line is not required to form a tuft for a more than a predetermined number of reciprocations of the needle bar after to the transitional line.

5 Claims, 8 Drawing Sheets

(56) References Cited

OTHER PUBLICATIONS

United Kingdom Search Report issued in related application GB 2110136.5, dated Apr. 5, 2022.

* cited by examiner

METHOD OF FORMING A PATTERNED CARPET IN A TUFTING MACHINE

The present invention relates to a method forming a patterned carpet in a tufting machine.

In such carpets, the applicant has identified that when pattern data requires a particular combination of colours, the tufting pattern required by this combination causes problems, in practice, in the finished tufted carpet.

In this specification, reference to the "line" is a reference to tufts which are arranged in a transverse direction (namely the direction in which the sliding needle bar moves, which is perpendicular to a longitudinal direction representing the direction in which the backing medium is fed through the tufting machine). Reference to a "row" is a reference to the tufts which extend in the longitudinal direction such that a row of tufts runs transverse to a line of tufts.

When tufting a line of tufts, in a machine set-up to create a multi-coloured carpet pattern, only the needle which has the colour of yarn required by the pattern data will tuft a yarn at the tuft area (corresponding to one "pixel" in the pattern). The majority of the needles will not be required to tuft at that area. These will either not be latched to the needle bar such that they do not reciprocate into the backing medium, or will reciprocate into the backing medium, but the yarns on these needles will not be engaged by the underlying hook/looper such that the yarn is pulled back out of the backing medium as the needle returns to the top of its travel.

For example, if the carpet consists of four colours, four strokes of the needle bar are required for each "pixel" in the pattern, allowing the sliding needle bar to be moved into the four different positions, to present the four different colours. In one of the four strokes, the needle with the desired colour is selected and forms a tuft for that "pixel".

Where the backing medium is fed through the tufting machine, the colour of yarn required to form the particular pixel may be the one which is presented on the final stroke of the needle bar associated with that tuft area. This tuft will be formed at the rearmost extremity of that tuft area. If, in an adjacent line, a second tuft in the same row as the first tuft, is tufted on the first reciprocation of the needle bar associated with that tuft area, this second tuft will be created at the foremost extremity of its tuft area. In this case, the two tufts will be created very close together.

The creation of the second tuft can therefore interfere with the first tuft, this might take the form of the second tuft replacing the first tuft, it may partially dislodge it, or all of the colours of the two tufts may blend into one another. This is particularly a problem for a woven backing cloth where the two tufts may end up in the same space between two wefts. Although this problem occurs more often when the backing medium is fed continuously through the tufting machine, it can also occur if the backing medium is fed intermittently through the tufting machine. Problems can occur whether the sliding movement of the needle bar follows a regular pattern in close relationship with the number of colours of the yarns or more intricate pattern.

As a result of this, uncontrollable and detrimental effects may occur in these regions and spoil the look of the carpet.

We have also identified a second problem. The sliding needle bar periodically changes its transverse direction such that it changes from sliding in a first transverse direction across the tufting machine, reaches a transitional line in which it turns and slides back in the opposite direction. For any tufts which are formed in such a transitional line, there can be a potential problem if the colour of yarn formed in that line is isolated in the sense that the needle containing that colour has not previously been selected for a number of tufts and is not subsequently due to be selected for a number of tufts. Under these circumstances, the isolated single tuft is not particularly firmly anchored within the backing material and the yarn leading to and from the isolated tuft on the underside of the backing medium is on the same side of the tuft such that any force on the yarn on the underside of the backing medium is exerted in essentially the same direction on the isolated tuft. Although more unlikely, isolated tufts placed on other lines than the transitional line can also experience this problem.

Again, this can lead to uncontrollable defects occurring in the finished carpet as the isolated tuft can be pulled low or out of the backing medium.

According to the first aspect of the present invention, there is provided a method according to claim 1.

With such a method, the desired pattern data is analysed any problem conditions such as those identified above can be identified.

Having identified these, the method may comprise changing a pattern or alerting the user to the existence of the problem. The operator may be given the option of either approach. If, for example, the pattern does not have a particularly geometric pattern, the user may elect to allow the changes to the design of pattern to be made automatically. However, in the case of a more geometric pattern, the user may prefer to be alerted to the existence of such problem and can therefore make a decision on whether and how vary the desired pattern data in order to avoid or alleviate the identified problem conditions without having an unacceptably detrimental effect on the actual pattern.

The overall effect of the invention is that, previously, the user had no way to control the tufting sequence in order to deal with any problems. As a consequence, the adverse effects in the finished carpet could not be predicted or controlled.

With the present invention, any such problem areas can be automatically avoided, or at least the user is offered the option of dealing with these in a manner which is under his control. He can therefore decide to make changes to the pattern, if appropriate, in a manner which will produce a product which is devoid of any uncontrolled problems.

US 2005/0188905 discloses analysing the pattern data to determine whether the number of colours required by the pattern data exceeds the number of available colours. If so it generates an error message. Similarly, US 2017/260668 discloses analysing the pattern data to determine whether there is sufficient yarn of a particular colour available to form the desired pattern. If not, the user is given the option of adjusting the pile height to reduce the amount of yarn required.

Both references are concerned of determining whether there is adequate yarn available to meet the pattern requirements. Neither of them are concerned with analysing pattern data to determine whether there will be physical problems with the formation of a particular pattern based on the relative location of at least two stiches in the desired pattern data. Thus, neither reference would be able to correct for the type of conditions identified by the present invention.

In order to alleviate the problem of conflicting yarns being formed in the extremities of their tuft area, the method preferably further comprises the features of claim 2.

The step of determining whether the tufts are spaced by less than a predetermined amount may comprise analysing the desired pattern data to determine if, for adjacent tuft areas, the tufts in a row will be spaced by less than a predetermined amount. Alternatively, or additionally, the step of determining whether the tufts are spaced by less than a predetermined amount may comprise analysing the desired pattern data to determine if, for adjacent tuft areas, the tufts in a line will be spaced by less than a predetermined amount.

In this case, changing the colour of a tuft may take the form of selecting a different colour of tuft for a particular tuft area, such that the chosen tuft is further from the extremity of that tuft area. Alternatively, changing of the colour of a tuft may take the form of swapping adjacent colours in the row of yarn such that the swapped colours are spaced by more than the predetermined amount.

In the case of problems arising for isolated yarns in transitional lines, the method preferably further comprises the features of claim 5.

This method can recognise that an isolated tuft is being formed in a transitional line and can alert the user or take remedial action. The first and second predetermined number of reciprocations can be set according to the conditions which are likely to give rise to problems. For example, a problem condition may have been deemed to occur if the needle of the new transitional line has not previously created a tuft or created a tuft for the previous 20 to 25 reciprocations and is not scheduled to do so for the subsequent 20 to 25 reciprocations.

In this case, the remedial action might involve changing the pattern data such that the isolated tuft in the transitional line is replaced with a colour which is being tufted by the same needle in closer proximity to the tuft in the transitional line. Alternatively, other tufts within the pattern may be altered such that additional tufts of the colour required in the transitional line are tufted by the same needle in close proximity to the transitional line such that the tuft in the transitional line is no longer isolated.

Having identified either of the above problems, alternatively, the user may elect not to make any changes if they consider that doing so would be more detrimental to the nature of the pattern than the potential interference between the yarns.

A further alternative, in either case, is to make larger scale adjustments to the pattern in order to alleviate such problems. In this case, the new pattern data can again be analysed in the same way to determine whether any new problems have been created. This can be an iterative process which is repeated on a number of occasions to reduce or eliminate the number of problem conditions that can be driven by the user themselves, or may be automated.

Another alternative, in either case, is that that the pattern data is analysed with different features of the tufting machine, such as a different order of yarn threading (e.g. instead of analysing the pattern data with yarn threading "red-green-yellow-blue" the pattern data could be analysed using the order "red-yellow-green-blue"). A user can then be advised that fewer problems arise with a different colour order.

A combination of the above methods may be used. For example the colours can be reordered to reduce the number of problems, then other methods can be used to deal with the remaining problems.

An example of a tufting machine and method for operating the tufting machine will now be described with reference to the accompanying drawings, in which.

Figure 1:
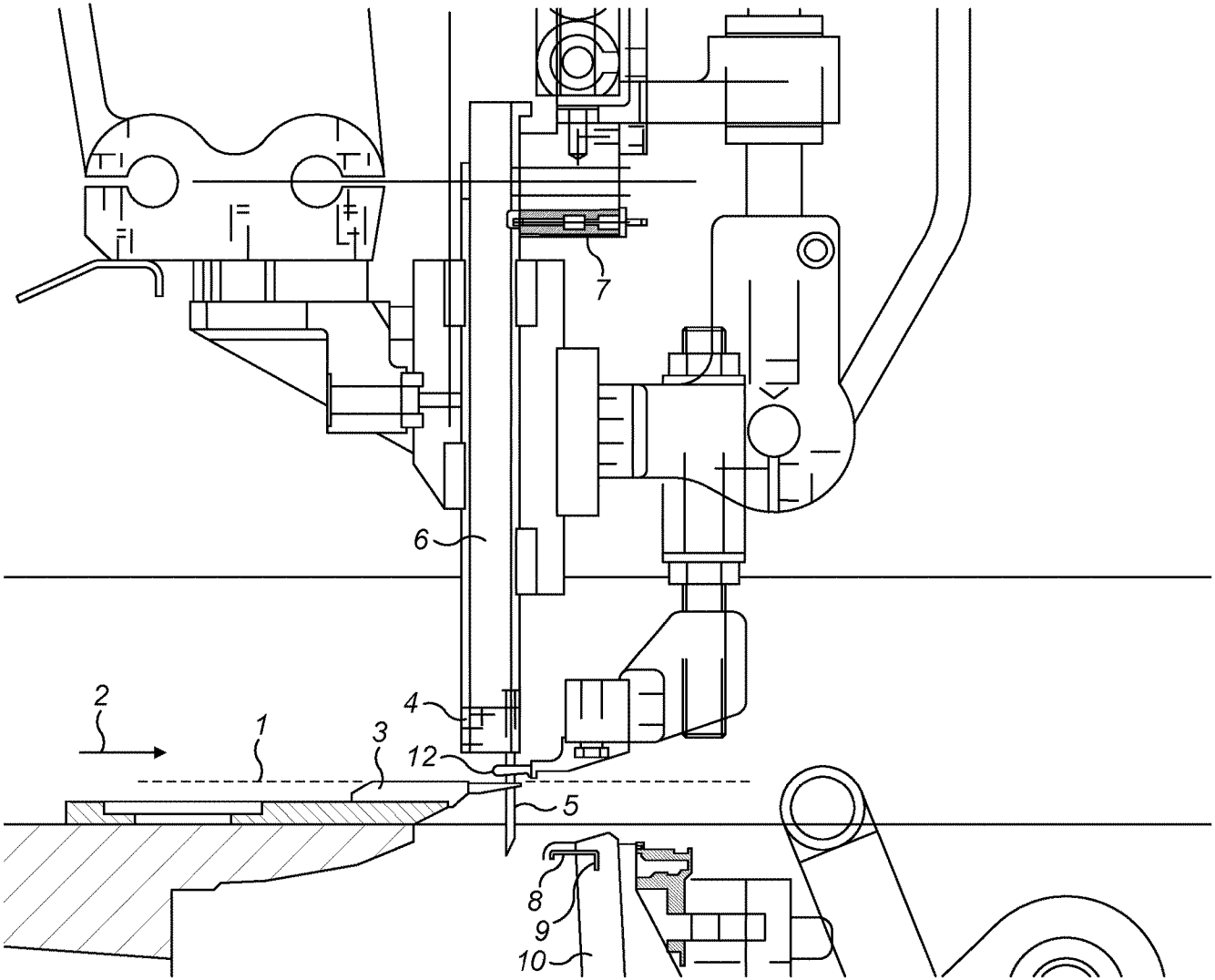
FIG. 1 is a cross-sectional side view of the tufting machine.

The tufting machine in FIG. 1 is a known individual needle control (ICN) machine. As this is conventional, only the main components will be described here.

The backing medium 1, depicted schematically as a dashed line in FIG. 1, is fed through the tufting machine in a longitudinal direction depicted by arrow 2 and is supported in the tufting position by a bed plate 3. The needle bar 4 supports a line of needles 5 (extending in a transverse direction perpendicular to the plane of FIG. 1). Each needle 5 is supported on a needle support 6. Each needle support 6 has an associated latch 7 such that, if the needle is required to be reciprocated in a particular stroke, the needle can be selectively latched to the needle bar 4 so that it will penetrate the backing medium 1 to form a tuft.

Beneath the backing medium 1 is a looper 8 associated with each needle 5. The loopers 8 will rock forwards to pick up a loop yarn formed by the needle 5. In this example, the loopers are level cut loopers (LCL). These having a latching mechanism which is configured either to ensure that the top of the yarn slips off the looper 8 or alternatively to ensure that it is retained in the looper 8 such that it slides back to a throat 9 of the looper and is cut by a respective knife 10 in order to form a cut-pile tuft. This mechanism is therefore capable of selectively forming loop or cut-pile tufts.

The invention is applicable to other types of tufting machine including those which do not have a latch 7 but instead rely on not picking up the loop of the yarn from the needle which penetrates the backing medium 1, so that loops of unwanted yarn are pulled back out through the backing medium. Further, the level cut loopers 8 make be replaced by hooks in order to produce a loop-pile carpet. Alternatively, there may be loopers on which all yarn is cut to produce cut-pile carpet.

The invention resides in the manner in which the tufting machine is programmed with a tufting pattern and this will now be described with reference to the remainder of the drawings.

Figure 2:
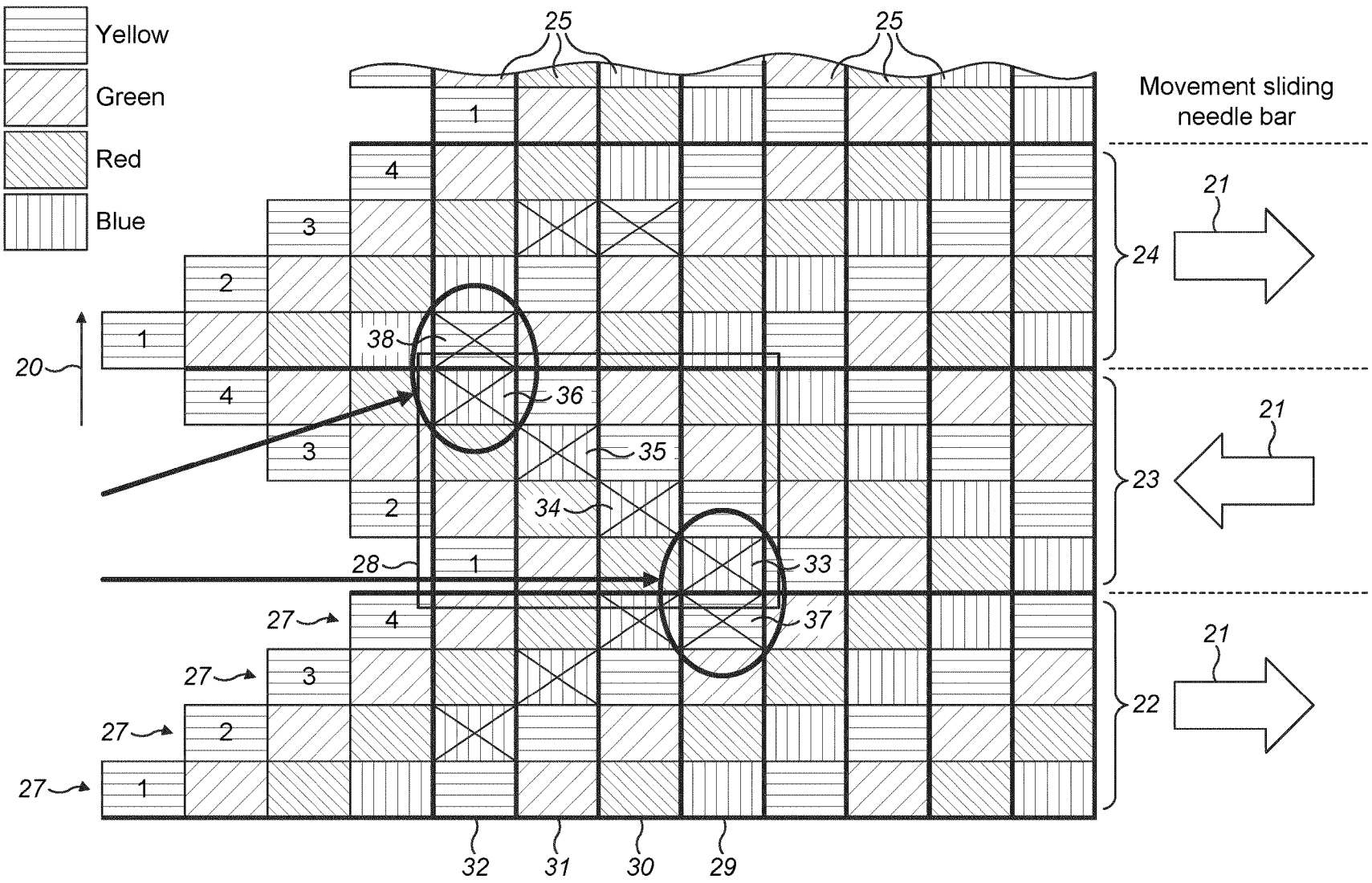
FIG. 2 is a diagram explaining a first problem addressed by the present invention.

With reference to FIG. 2, the orientation and notation of the diagram will first be described. Each rectangle in the diagram represents a location where a needle 5 can penetrate the backing medium 1. Arrow 20 represents the longitudinal direction, which is the direction in which the backing medium 1 advances through the tufting machine. Arrows 21 represent the lateral direction which is the direction in which the needle bar 4 slides across the tufting machine.

The diagram represents a four colour tufting machine in which the colours are equally spaced across the machine. In terms of the pattern data, each region 22, 23, 24 represents one line of the pattern. Each sub-line 27 represents a position within the line 22 where a tuft can be formed. In order to not complicate the explanation too much, the sliding movement of the needle bar in the discussed embodiments follows a regular pattern in close relationship with the number of colours of the yarns. Of course the same possibilities, consequences and conclusions also apply when the sliding movement of the needle bar follows a more intricate pattern.

In the central part of FIG. 2, those yarns which have been selected for tufting in a particular sub-line are designated as a box with a cross. The left and right hand portions of this Figure will also have various yarn selected, but only the central part has been illustrated for ease of explanation.

For the sake of illustration, the formation of the tufts in the rectangle 28 will now be described. This rectangle is formed in a line 23 representing a single line of pattern data. The line is formed in four reciprocations of the needle bar as the needle bar moves from left to right as designated by the arrow 21. In this region, the pattern data requires four blue tufts to be created in rows 29 to 32.

In the first reciprocation, the needle with the blue yarn is in row 29. The blue needle is selected for tufting, for example, by activating the latch 7, while the needles with the red, green and yellow yarn are not selected. On this stroke of the needle bar, the blue yarn 33 is tufted. The needle bar 4 then shifts one row to the left while the backing medium 1 moves in the direction of arrow 20 the width of one of the sub-lines 27. The needle with the blue yarn is again latched while the others remain unlatched, thereby forming tuft 34 in line 30. This process is repeated twice more, such that blue tufts 35 and 36 are formed in rows 31 and 32 respectively.

In each of rows 29 to 32, there is a tuft area which, in FIG. 2, is represented by one row of four tufts within the rectangle 28. Thus, for example, in row 31, the tuft area is the yellow rectangle above the tuft 35 down to the green rectangle two spaces below the tuft 35. In row 31, this represents the tuft area, in that, the tuft required to be formed in line 23 and row 31 would be in one of the four spaces along this row depending upon its colour. If a yellow tuft is formed in row 31, this would be formed in the rectangle above a tuft 35, while if it is red tuft it would be a rectangle below tuft 35, and the green tuft will be in the rectangle below that.

As would be appreciated from the above explanation, the tuft 33 in row 29 is formed at the rearmost extremity of the tufting area, while the tuft 36 is formed at the foremost extremity of the tufting area.

Although the rectangle 28 depicts each sub-line 27 as being the same as the width of the tuft, in practice, this is not the case as the increments between the adjacent lines 27 are much smaller than the size of the tuft. This has the effect of compressing FIG. 2 in the direction of arrow 20 so that, in an actual carpet produced with this design, the line of diagonal tufts 33 to 36, while offset to some extent, will actually appear to be much closer to a straighter line of tufts, extending in the lateral direction.

With reference to the line 22, as can be seen in FIG. 2, in rows 30 to 32, a blue tuft is created. This is always spaced from the tufts in line 23 as it is only row 29 that line 23 has a tuft 33 in close proximity to line 22. As shown in this illustration, row 29 is formed with a yellow tuft 37. Because of the manner in which the needles are threaded, this yellow tuft 37 in line 22 is at the foremost extremity of its tufting area and is therefore formed very close to tuft 33 of the adjacent line 23 which is at the rearmost extremity of the tufting area.

A similar effect is shown in line 24 in which row 32 has a yellow tuft 38 which is directly adjacent to the blue tuft 36 in row 32.

Because these two pairs of tufts 33, 37, and 36, 38 are formed very close to one another, there is the possibility that they can interfere with one another. In particular, for a woven backing cloth, both tufts may be formed between the same pair of wefts. These can potentially interfere to the extent that the second tuft will fully displace the original one, or at least partially dislodge it or its fibres will intermingle with those of the earlier formed tuft. This forms unwanted and uncontrollable effects in these regions.

Designing a pattern for a carpet to be tufted in a tufting machine consists of several steps. The designer or programmer designs the pattern, usually independent or even unaware of the features of the tufting machine. In a second step, the tufting machine software (such as our tuftlink software or e.g. software from Nedgraphics) processes the designed pattern and translates it to data the tufting machine can read and can execute.

When programming the pattern data, these problems as addressed before will not be apparent to the programmer as they will not know the threading sequence of the needles. The pattern software algorithm is programmed with desired pattern data, the sliding needle bar movement pattern, the yarn threading sequence, and the manner of feeding the backing medium (intermittent or continuously). It will then analyse the pattern data and look for any problems such as those described above where adjacent tufts in a line have the minimal spacing. It can then alert the user to any instances where this occurs. A number of potential solutions to this problem are set out below.

Figure 3:
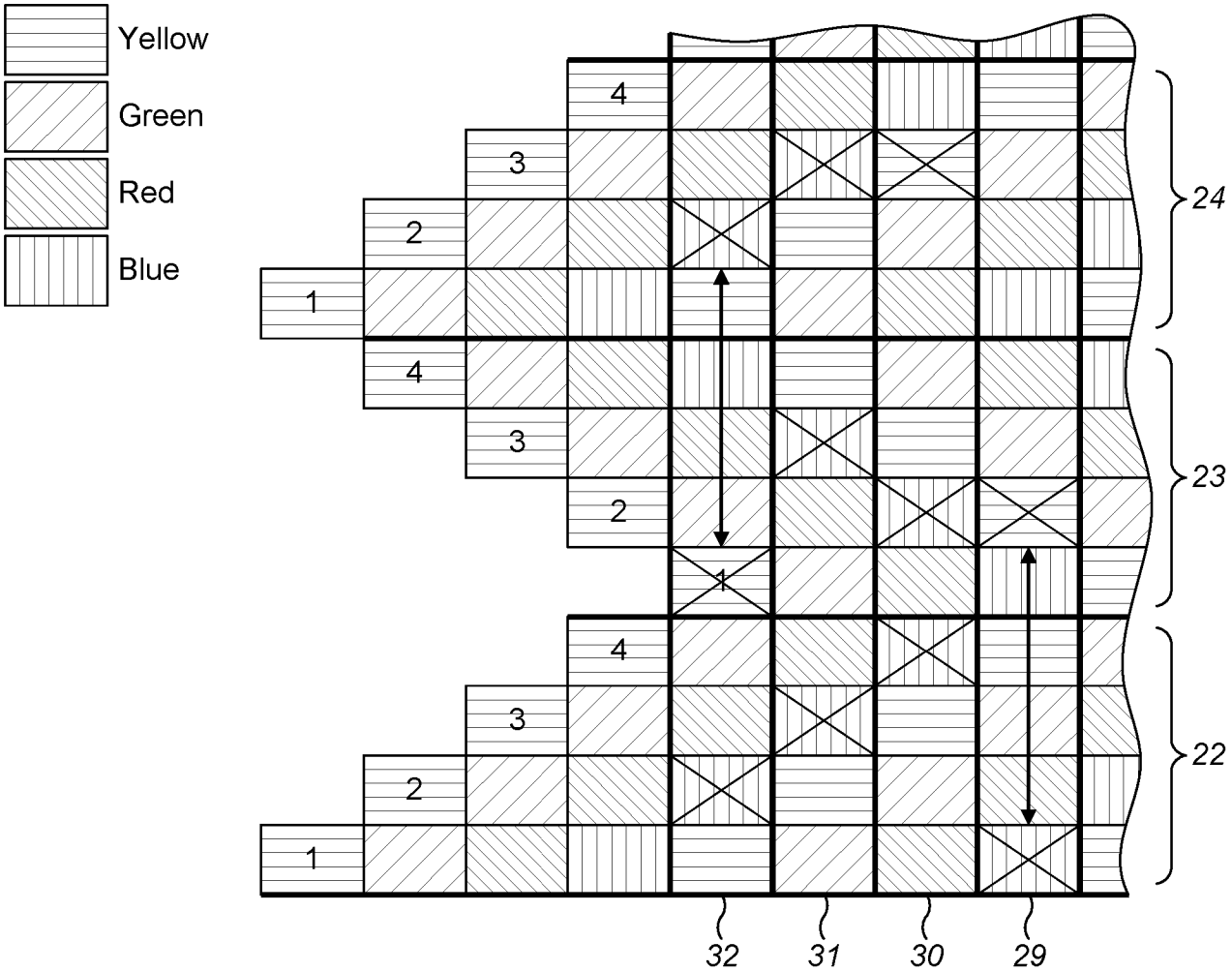
FIG. 3 is a similar diagram showing a solution to this problem.

FIG. 3 depicts the same pattern as FIG. 2, except that it has been adapted to remove any tufts which are spaced too closely together. Thus, in row 29, where the original pattern data calls for a yellow tuft in line 22 and the blue tuft in line 23, these have been swapped over so that the blue tuft is now formed in line 22, and the yellow tuft is formed in line 23. Similarly, in row 32, whereas the pattern data called for a blue tuft in line 23 and a yellow tuft in line 24, these have again been swapped so that the yellow tuft is formed in line 23 and the blue tuft is formed in line 24.

Figure 4:
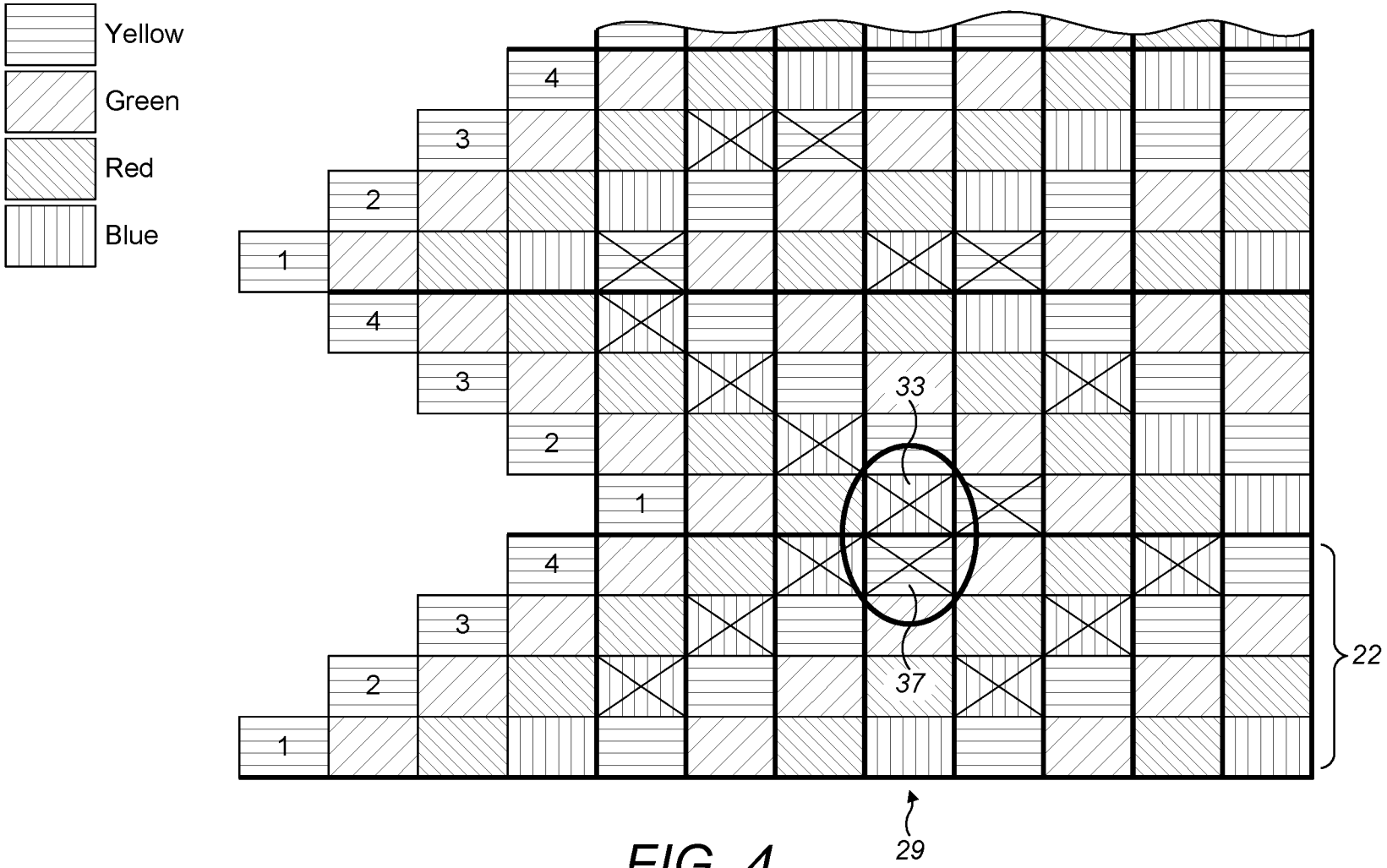
FIG. 4 is a similar diagram showing a second problem.
Figure 5:
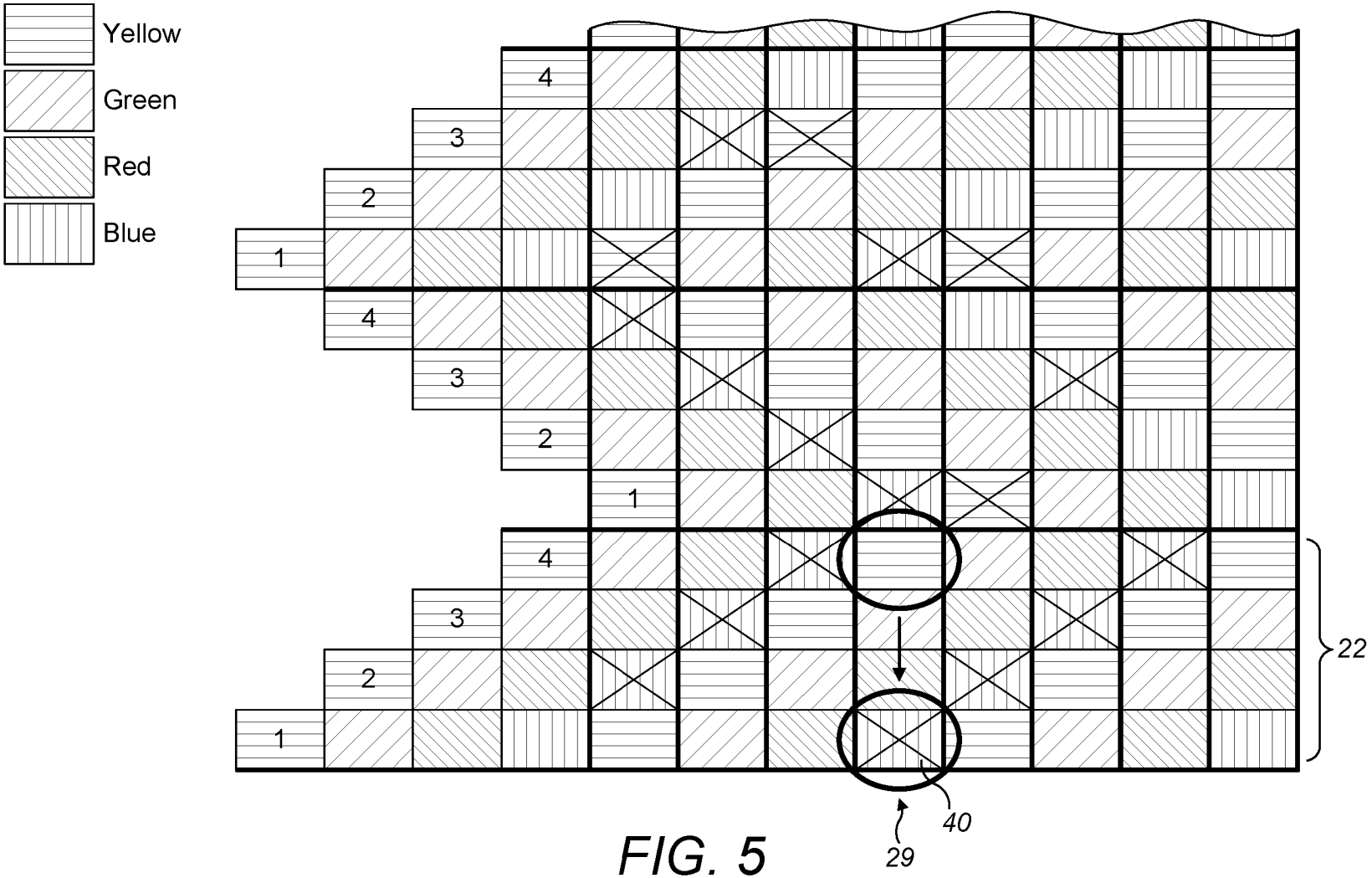
FIG. 5 is a similar diagram showing a solution to the second problem.

FIG. 4 shows a situation similar to FIG. 2 in which there is again a problem with the tufts 33, 37 in line 29. In this case, rather than swapping the colours between adjacent lines, the tuft 40 formed in row 29 of line 22 is changed from a yellow tuft 37 to a blue tuft 40 as shown in FIG. 5. This is the preferred alteration in this case, because, as shown in FIG. 5, much of the surrounding area including the part of the carpet to the right of row 29 is formed of blue tufts, so this is the least noticeable modification.

Figure 6:
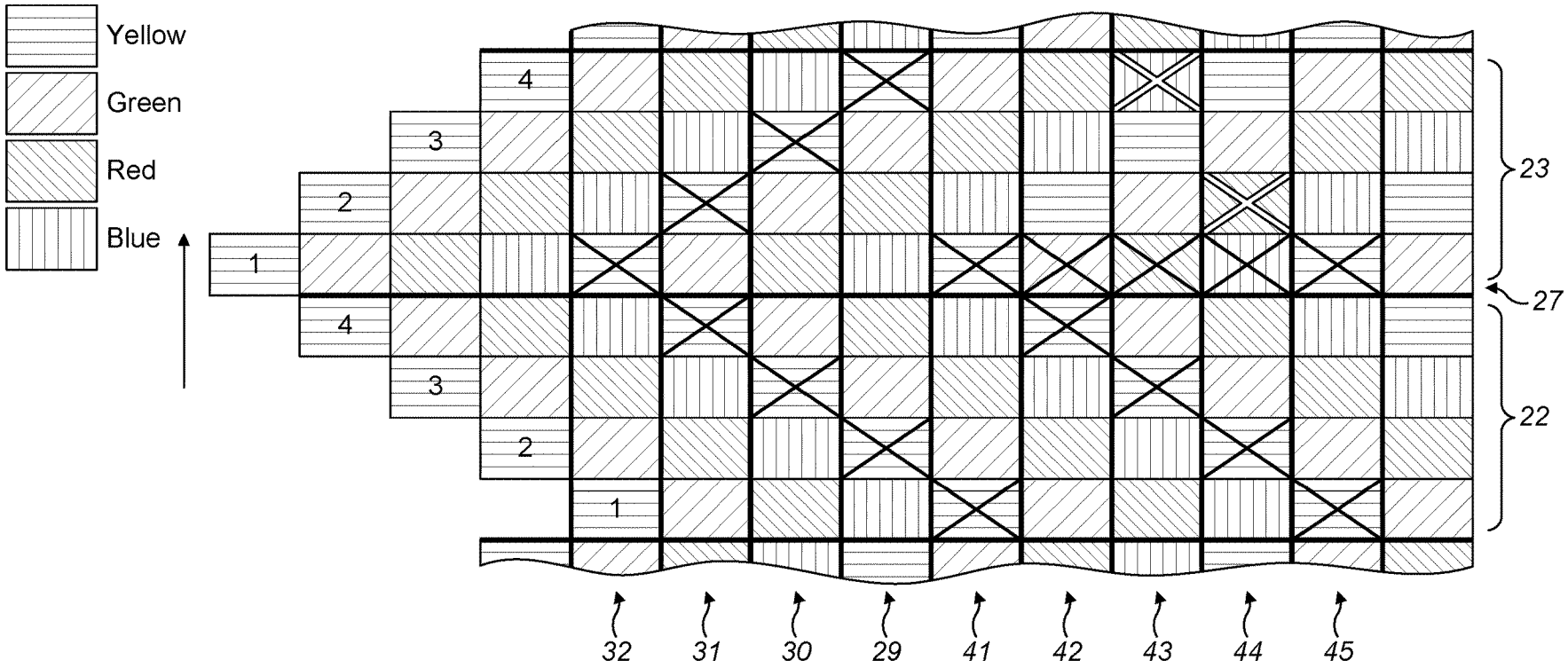
FIG. 6 is a similar diagram showing a third problem and solution.

A similar issue to that described above is illustrated in FIG. 6. In this case, the tufts which are formed in each location are designated by a black X. The pattern requires yellow stitches in rows 29 to 32 which is not problematic. However, in the first sub-line 27 in region 23, the pattern requires a mixture of colours to be formed (from left to right in FIG. 6—yellow, green, red and blue). A yellow stitch is also required in row 45. Because of this particular stitch selection, all of the stitches are formed in adjacent locations in sub-row 27.

When this happens with three or more stitches, the adjacent stitches are very close to one another as they are not offset, to any extent, in the longitudinal direction 20. As set out in the previous example, the stitches can interfere with, displace, swap with or displace one another. As such, this is also a condition which may be desirable to avoid. As before, there are a number of remedial actions which can be taken. In this case, the stitch colours in rows 43 and 44 have been swapped such that a blue tuft is formed in row 43 and a red tuft is formed in row 44 as designated by the white X's. It is usually simplest to change a central tuft, or at least one which is flanked on both sides by an adjacent tuft. Instead of swapping colours, the yarn in row 43 can simply be changed for a yarn of a different colour in order to alleviate the problem.

Figure 7:
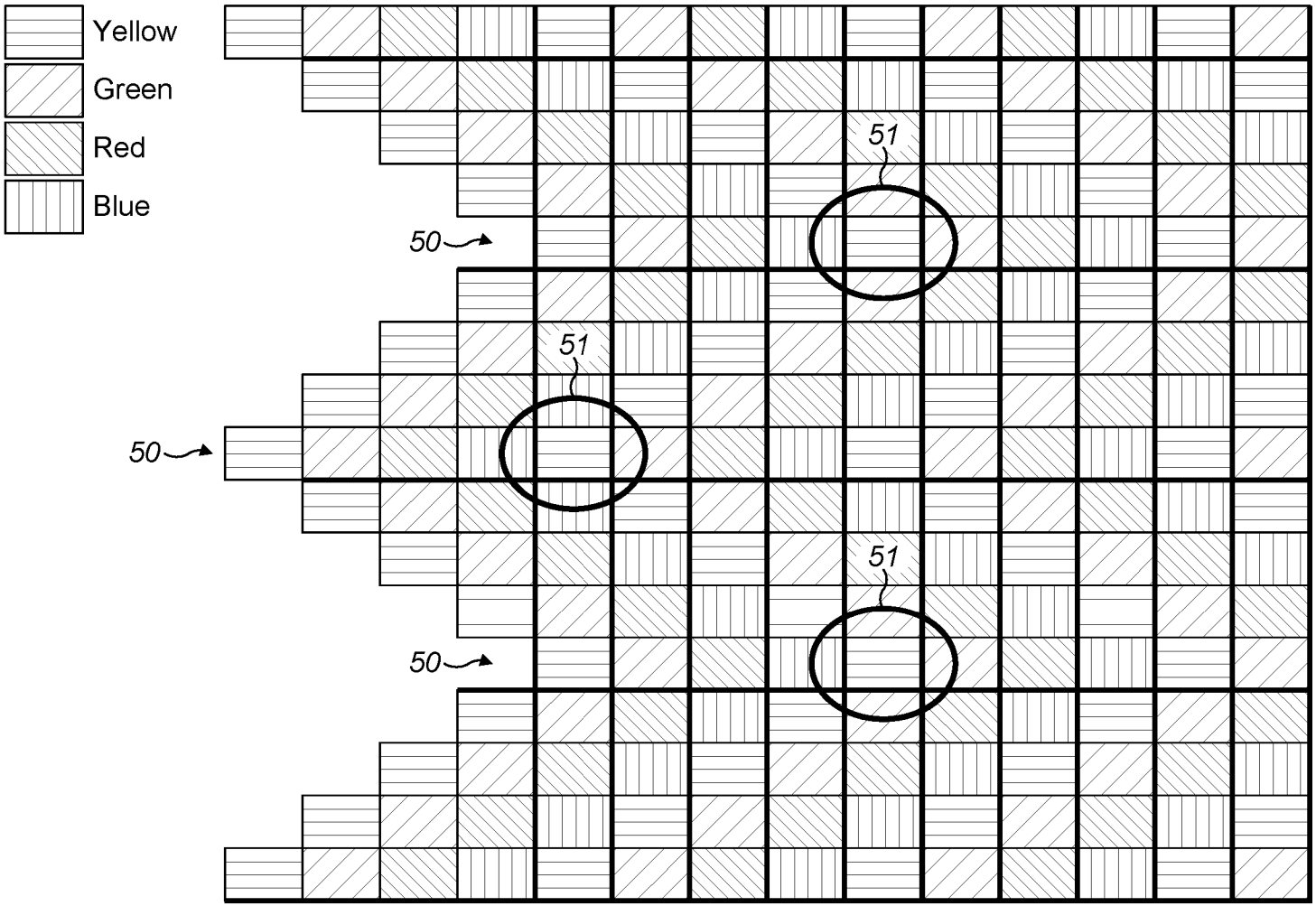
FIG. 7 is a similar diagram showing a fourth problem.

FIG. 7 is an illustration of a further problem which can arise. In certain lines 50, the needle bar will change lateral direction. In FIG. 7, this happens every fifth stroke. In FIG.

7, certain yellow tufts 51 have been circled as example of such tufts, but the same could apply to any colour in any of the lines 50. If a colour is selected for tufting these transitional lines but this colour is not been tufted by that same needle for some lines previously or subsequently, these unique circumstances create a problem in that the isolated tufts 51 can be pulled out of the backing medium 1 due to the tension in the yarn on the underside of the backing medium 1 and the weak anchorage of the isolated tuft.

The patterning software can analyse the pattern data, firstly recognising the transitional lines 50 and then identifying where any tufts are created in these lines which are not required from the same needle for a certain number of lines either side of the transitional line 50.

Figure 8:
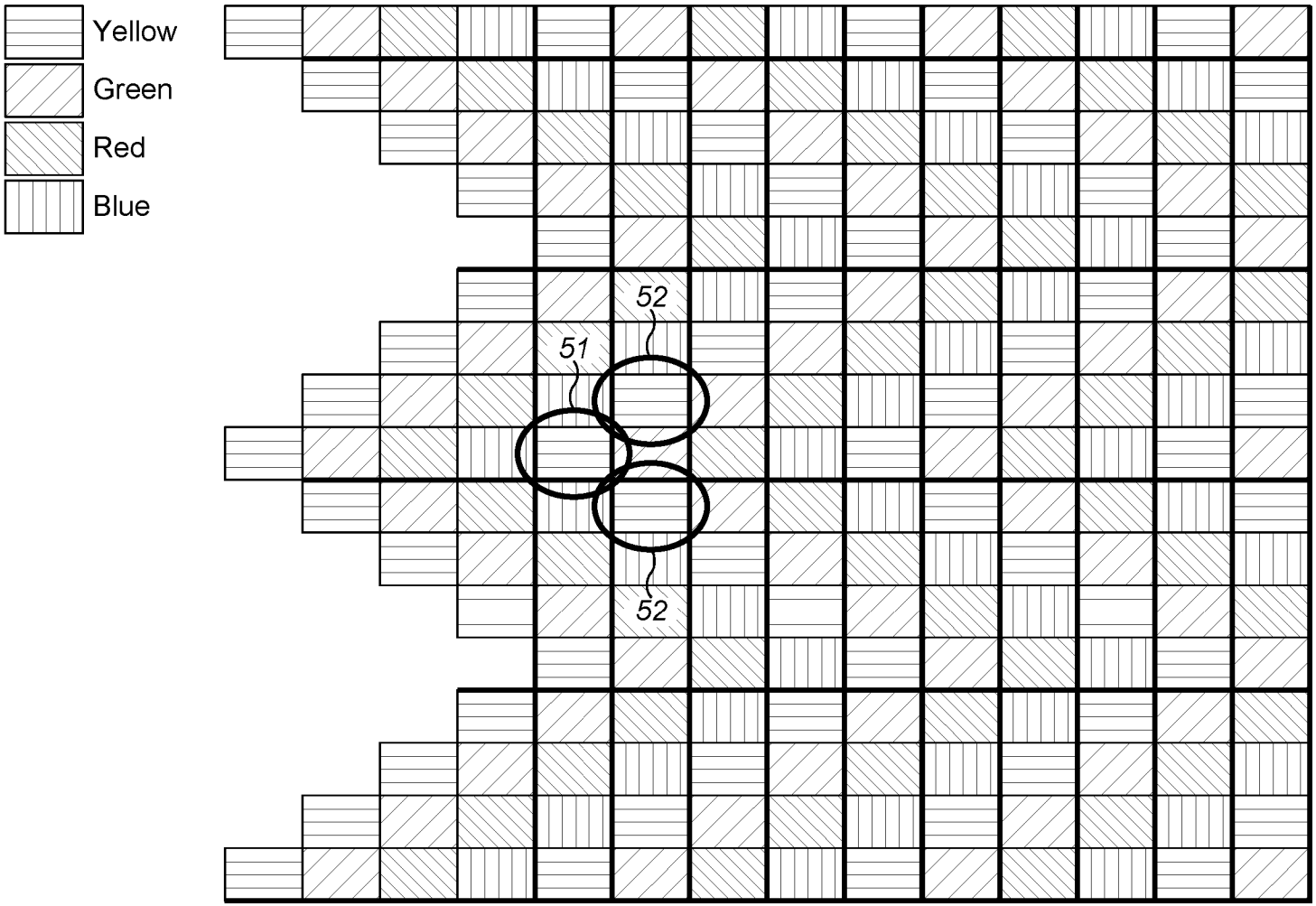
FIG. 8 is a similar diagram showing a fourth problem.

When this happens, the patterning software can alert the user to this situation so that they can take remedial action, or can carry out this remedial action automatically. One possibility is to substitute the tuft 51 for a colour which is tufted within adjacent lines either side. A further possibility is illustrated in FIG. 8 in which the pattern data can be modified in order to produce an additional tuft 52 before and/or after the isolated tuft 51. This then provides additional anchor points for the otherwise isolated tuft 51.

The invention claimed is:

1. A method of forming a patterned carpet in a tufting machine, the tufting machine comprising a means for feeding a backing medium through the tufting machine in a longitudinal direction;

a sliding needle bar comprising a plurality of needles, the bar being slidable in a transverse direction and reciprocal in a vertical direction so that the needles penetrate the backing medium being fed through the machine thereby forming tufts of yarn;

the method comprising:

defining a tuft area for each tuft required by the desired pattern data, the tuft area representing the area on the backing medium where the tuft can be placed:

calculating where in the tuft area a tuft will be placed;

analysing desired pattern data to determine if, for adjacent tuft areas, the tufts will be spaced by less than a predetermined amount and, if so, either changing, or alerting a user to allow the user to change, the colour of at least one tuft from that required by the desired pattern data to create actual pattern data in which the spacing of the adjacent tufts is more than the predetermined amount; and tufting the carpet according to the actual pattern data.

2. A method according to claim 1, wherein the step of analysing the desired pattern data comprises analysing the desired pattern data to determine if, for adjacent tuft areas, the tufts in a row will be spaced by less than a predetermined amount.

3. A method according to claim 1, wherein the step of analysing the desired pattern data comprises analysing the desired pattern data to determine if, for adjacent tuft areas, the tufts in a line will be spaced by less than a predetermined amount.

4. A method according to claim 1, further comprising:

identifying a transitional line of tufts in which the needle bar makes its final tufts before changing transverse direction;

wherein the step of analysing pattern data comprises analysing the desired pattern data to determine, for each needle in the transitional line, whether it is required to form a tuft for a first predetermined number of reciprocations of the needle bar prior to the transitional line and to form a tuft for a second predetermined number of reciprocations of the needle bar after to the transitional line;

and wherein, if a needle in the transitional line is not required to form a tuft for more than the first and second predetermined number of reciprocations of the needle bar;

the step of either changing, or alerting a user comprises either changing, or alerting a user to allow the user to change, the colour of a tuft from that required by the desired pattern data to create actual pattern data in which the needle in the transitional line is not required to form a tuft for more than the first or second predetermined number of reciprocations of the needle bar.

5. A method of forming a patterned carpet in a tufting machine, the tufting machine comprising a means for feeding a backing medium through the tufting machine in a longitudinal direction;

a sliding needle bar comprising a plurality of needles, the bar being slidable in a transverse direction and reciprocal in a vertical direction so that the needles penetrate the backing medium being fed through the machine thereby forming tufts of yarn;

the method comprising:

identifying a transitional line of tufts in which the needle bar makes its final tufts before changing transverse direction;

analysing the desired pattern data to determine, for each needle in the transitional line, whether it is required to form a tuft for a first predetermined number of reciprocations of the needle bar prior to the transitional line and to form a tuft for a second predetermined number of reciprocations of the needle bar after to the transitional line;

and wherein, if a needle in the transitional line is not required to form a tuft for more than the first and second predetermined number of reciprocations of the needle bar;

either changing, or alerting a user to allow the user to change, the colour of a tuft from that required by the desired pattern data to create actual pattern data in which the needle in the transitional line is not required to form a tuft for more than the first or second predetermined number of reciprocations of the needle bar; and tufting the carpet according to the actual pattern data.

* * * * *